US005178273A

United States Patent [19]

Igarashi

[11] Patent Number: 5,178,273

[45] Date of Patent: Jan. 12, 1993

[54] GOLF CLUB BAG WITH INTEGRATED SUPPORT LEGS

[76] Inventor: Lawrence Y. Igarashi, 30231 Tomas Rd., Rancho Santa Margarita, Calif. 92688

[21] Appl. No.: 850,671

[22] Filed: Mar. 11, 1992

[51] Int. Cl.[5] ..... A63B 55/00

[52] U.S. Cl. ..... 206/315.7; 206/315.6; 206/315.8; 248/96

[58] Field of Search ..... 248/96; 206/315.6, 315.7, 206/315.8

[56] References Cited

U.S. PATENT DOCUMENTS

| | | | |
|---|---|---|---|
| 846,552 | 3/1907 | Collins et al. | 248/96 |
| 1,181,007 | 4/1916 | Henneberg | 248/96 |
| 1,404,559 | 1/1922 | Watrous | 248/96 |
| 1,686,774 | 10/1928 | Sperry | 248/96 |
| 1,840,663 | 1/1932 | Gallagher | 248/96 |
| 1,916,612 | 7/1933 | Galt | 248/96 |
| 1,970,849 | 8/1934 | Gunther | 248/96 |
| 2,282,842 | 5/1942 | Abell | 248/96 |
| 2,364,223 | 12/1944 | Keim | 206/315.3 |
| 2,628,801 | 2/1953 | Gunning | 248/96 |
| 3,787,017 | 1/1974 | Sauer | 248/96 |
| 4,266,389 | 10/1980 | Neth | 248/96 |
| 4,266,589 | 5/1981 | Cochran | 150/1.5 B |
| 4,453,686 | 6/1984 | Ina | 248/168 |
| 4,506,854 | 3/1985 | Kim | 248/96 |
| 4,620,682 | 11/1986 | Yim | 248/96 |
| 4,655,346 | 4/1987 | Reinholz | 206/315.6 |
| 4,676,464 | 6/1987 | Reimers | 248/96 |
| 4,685,561 | 8/1987 | Reimers | 206/315.6 |
| 4,739,958 | 4/1988 | Sato | 248/96 |
| 4,798,357 | 1/1989 | Cho | 248/96 |
| 4,834,235 | 5/1989 | Solheim et al. | 206/315.7 |
| 4,921,192 | 5/1990 | Jones | 248/96 |
| 4,949,844 | 8/1990 | Yang | 206/315.7 |
| 5,036,974 | 8/1991 | Ross, Jr. | 206/315.7 |
| 5,042,654 | 8/1991 | Jones | 206/315.3 |
| 5,048,777 | 9/1991 | Quellais | 248/96 |

FOREIGN PATENT DOCUMENTS

| | | | |
|---|---|---|---|
| 155266 | 3/1921 | United Kingdom | 206/315.6 |
| 331668 | 7/1930 | United Kingdom | 206/315.6 |
| 2098075 | 11/1982 | United Kingdom | 248/97 |

*Primary Examiner*—Ramon O. Ramirez
*Attorney, Agent, or Firm*—Roberts and Quiogue

[57] ABSTRACT

A golf bag with integrated support legs is disclosed. The legs are pivoted at the top of the bag, and may be extended to a stand position, forming a support stand for the golf bag to support the bag in an inclined position. A flexible rod extends longitudinally along a side of the bag between the legs, with a spring member extending between the bottom support of the bag and respective positions intermediate the leg ends. To cause the legs to be opened to the stand position from a upright position adjacent the bag body, a force is applied to the top of the flexible rod, causing it to flex and thereby pivot the legs outwardly to the stand position. When the bag is picked up the legs are automatically restored to the upright position.

19 Claims, 2 Drawing Sheets

GOLF CLUB BAG WITH INTEGRATED SUPPORT LEGS

BACKGROUND OF THE INVENTION

The present invention relates to golf club bags, and more particularly to golf bags having integrated support legs which extend to support the bag.

There are many types of golf bags which have been devised to assist the golf player in organizing and containing the player's golf clubs and accessories. Minimizing the weight of the golf bag is especially important to players which carry the golf bag during play instead of using a golf cart to transport the bag during play. Another desirable feature is to provide the bag with legs which extend to support the bag while the player is making a shot on the course.

It is therefore an object of this invention to provide a golf bag which is lightweight and suitable for carry use while at the same time incorporating an integrated set of support legs which form a stand for the bag when put down by the player.

SUMMARY OF THE INVENTION

A golf bag with integrated support legs is disclosed, and comprises a golf bag body fabricated from a flexible lightweight material, such as nylon fabric. A top support member is fabricated of a rigid material, and defines a top opening of the golf bag. The bag body is secured at the top thereof to the top support member. A bottom support member is also fabricated of a rigid material, the bag body being secured at the bottom thereof to the bottom support member.

A flexible rod member extends longitudinally along one side of the bag body, the top rod end being secured at the top support member, the bottom rod end being secured at the bottom support member.

The bag further comprises first and second leg members each having a top end and a bottom end. The top end of each leg is pivotally connected at the top support member.

A substantially rigid spring member is connected between the bottom member and each leg at a position between the top and bottom ends of the leg.

The legs can be actuated to a stand position by exerting a downwardly extending force on the flexible rod as the bag is in an upright position with the bottom member resting on the ground. This forces the rod to flex and the legs to be pivoted outwardly away from the bag body into a stand position. The legs are automatically retracted to an upright position against the bag body upon lifting the bag off the ground.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 3:
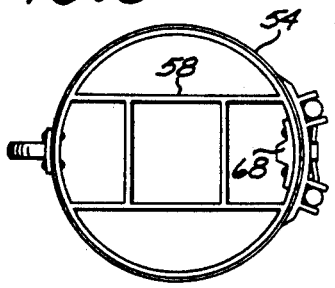
FIG. 3 is a top view of the golf bag of FIG. 1.
Figure 4:
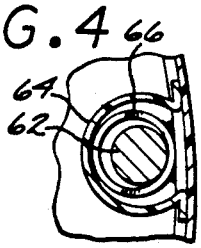
FIG. 4 is a partial cross-sectional view taken along line 4—4 of FIG. 1.

An exemplary embodiment of a golf bag 50 embodying the invention is illustrated in FIGS. 1–7. The body 52 of the bag 50 is fabricated of a lightweight, strong fabric such as nylon. A top bag support member 54 and a bottom cup-shaped support member 56 are fabricated from a molded plastic material. The fabric comprising the body 52 is secured to the top and bottom members 54 and 56 by conventional techniques. As shown in FIG. 3, the top support member includes a network 58 of connected ribs which extend across to open top of the bag to separate the golf clubs, in the conventional manner. A handle 60 is also secured to the outside of the top support member and the fabric body. A rigid plastic reinforcing sheet 61 is fitted to the inside of the bag body material opposite the handle 60 to support the handle. The reinforcing sheet 61 extends upwardly to inside the top support member 54. The handle 60 is secured to the top member 54, the bag body material 54 and the reinforcing sheet 62 by rivets or other conventional fasteners.

Figure 5:
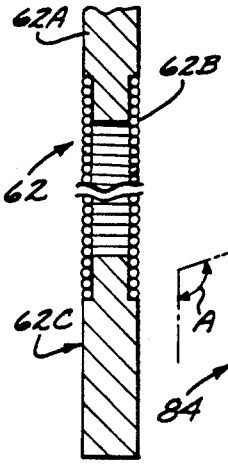
FIG. 5 is a partial cross-sectional view taken along line 5—5 of FIG. 1.
Figure 6:
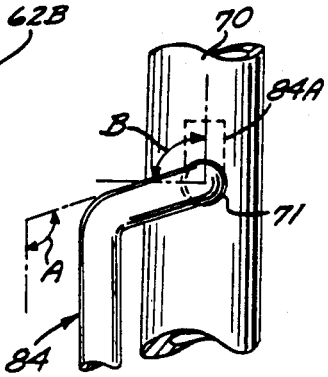
FIG. 6 illustrates the connection of the spring member into an opening formed in one of the legs of the golf bag of FIG. 1.
Figure 7:
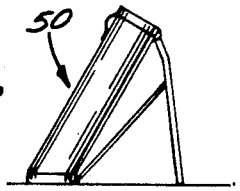
FIG. 7 is a front view of the golf bag of FIG. 1, showing the legs in the extended position to support the bag.

The foregoing structure would result in a collapsible bag. To stiffen the bag and prevent it from collapsing, a rod 62 is inserted within a fabric sleeve 64 which extends longitudinally between the top and bottom members 54 and 56. The bottom of the rod 62 is fitted into a cup 66 defined in the bottom member 56. The top of the rod 62 is captured in a cap member 68 secured to the top support member 54. In this embodiment, the rod 62 is characterized by a degree of springy resiliency or flexibility, which may be provided by a solid rod member 62A which is connected adjacent the bottom member 56 to a coiled spring 62B, which is in turn also connected to a second solid rod member 62C, as shown in FIG. 5. The rod members 62A and 62C are fabricated in this embodiment of hollow aluminum pipe. The coil spring 62B is fabricated of hardened steel to withstand fatigue. The composite rod 62 can be flexed about the coil spring, and this characteristic is exploited in the operation of the legs 70 and 72.

The bag 50 further comprises a pair of legs 70 and 72, which are pivotally attached to the top support member 54 on the same side as the rod 62, so that the rod 62 extends between the two legs 70 and 72. The legs are attached to pivot brackets 74 and 76 which are attached to the top member 54, by pivot pins 78 and 82.

The legs 70 and 72 are held in the normally closed position adjacent the bag body 52 by a spring member 84. The spring 84 is fabricated of an elongated metal rod, and is attached to the bottom support member 56 by a fabric loop 86 secured to the member 56. An opening is formed in each leg 70 and 72 in which to receive a corresponding end of the spring 84. The ends of the spring are bend in two planes to form angles A and B, illustrated in FIG. 6, which shows leg 70 with end 84A of the spring 84 received in circular opening 71 formed in the side of the leg 70. In this exemplary embodiment, the angle A is about 110 degrees, and angle B is a right angle. The angle A provides additional leverage against the leg when the legs are opened into a stand position shown in FIG. 7.

The legs of the bag 50 are opened into the stand position in the following manner. The player positions the bag on the ground in a substantially upright position. With his hand, the player exerts a downwardly extending force on the top support member 54 at position 90, causing the rod 62 to flex inwardly into the bag interior. A sheet layer of rigid reinforcing plastic 92 may be positioned at the lower end of the rod adjacent the coil spring 62B to prevent the rod from flexing outwardly. The flexing of the rod 62 results in a reduction in the distance between the bottom member 56 and the pivot pins 78 and 82 about which the tops of the legs pivot. As a result in this distance reduction, the ends of the spring 84 exert a force on the legs 70 and 72, causing the legs to pivot outwardly in the direction of arrow 94 in FIG. 1, the lower ends of the legs moving away from each other since the pivot axes of the legs are not colinear, but are at an angle with respect to each other, as shown in FIG. 3. The lower ends of the legs move apart against the tension in the spring member 84. The legs in the outward stand position together with the bottom member 56 create a tripod arrangement which forms a stable stand. The player can release the force at point 90, and the legs will remain in the stand position, the tension in the spring rod 62 tending to restore the rod to its unflexed position being insufficient to restore the legs to the upright position against the bag body 52 while the weight of the bag is in the inclined, stand position of FIG. 7. When the player is ready to pick up the bag 50, he can simply pick the bag up by handle 60, lift the bag and legs off the ground, and the legs will automatically retract to the upright position against the body 52 of the bag, due to the tension of the spring 62B and spring 84.

Figure 1:
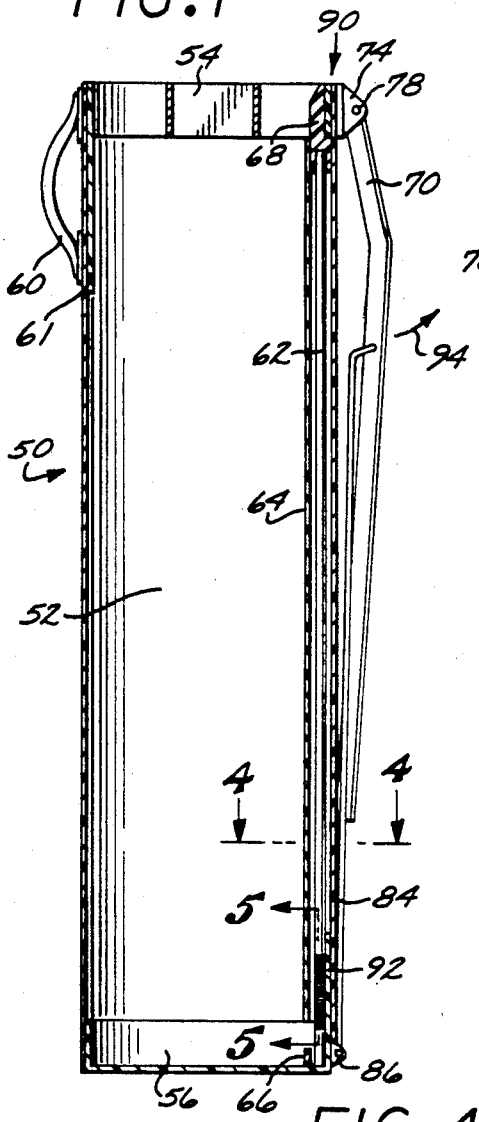
FIG. 1 is a front elevation view of a golf bag embodying the present invention.
Figure 2:
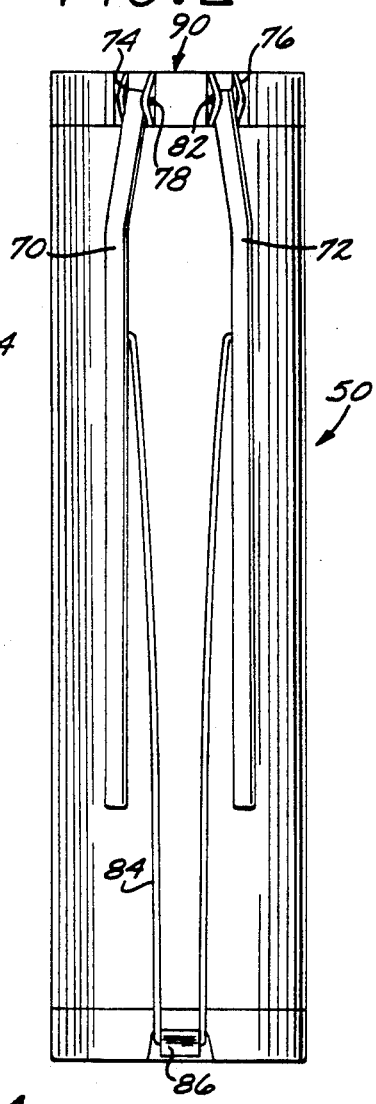
FIG. 2 is a side elevation view of the golf bag of FIG. 1.
Figure 8:
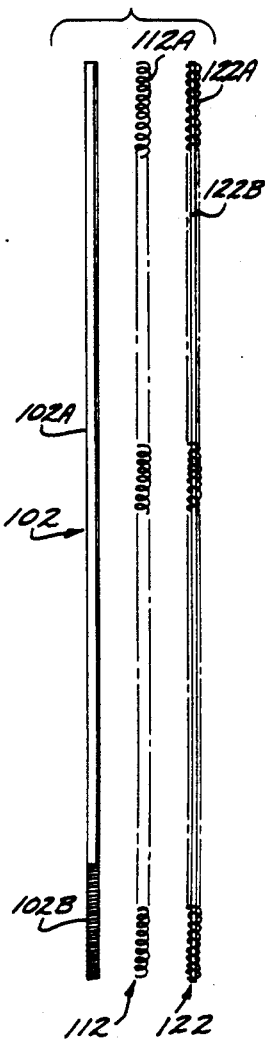
FIG. 8 illustrates three alternate configurations of the spring rod comprising the golf bag of FIG. 1.

Other forms of the rod 62 may be employed in a golf bag in accordance with the invention. FIG. 8 shows three alternate embodiments as rods 102, 112 and 124. Rod 102 comprises a rigid rod member 102A, to which at the lower end thereof is secured a length of coil spring 102B. In this embodiment, the rod flexing occurs at the coil spring at the lower end of the rod.

Even more flexibility is provided by the rod 112, which comprises an elongated section of coil spring 122A. This rod can flex along its entire length.

Rod 122 comprises an elongated coil spring 122A, and a thin flexible shaft 122B which fits within the coil spring and extends along its length. The shaft 122B stiffens the rod 122 in relation to rod 112.

Figure 9:
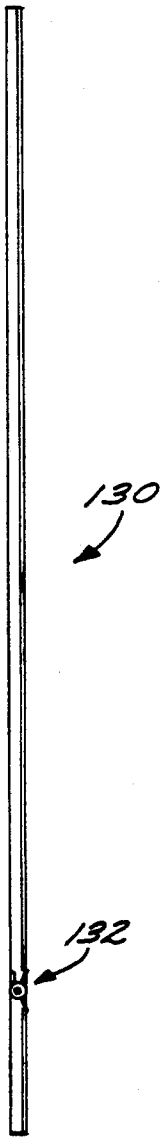
FIGS. 9–11 show another alternative embodiment of the spring rod comprising the golf bag of FIG. 1.
Figure 10:
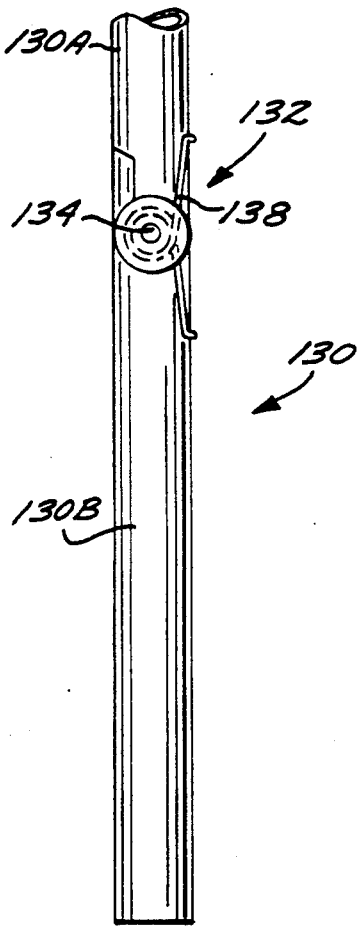
Figure 11:
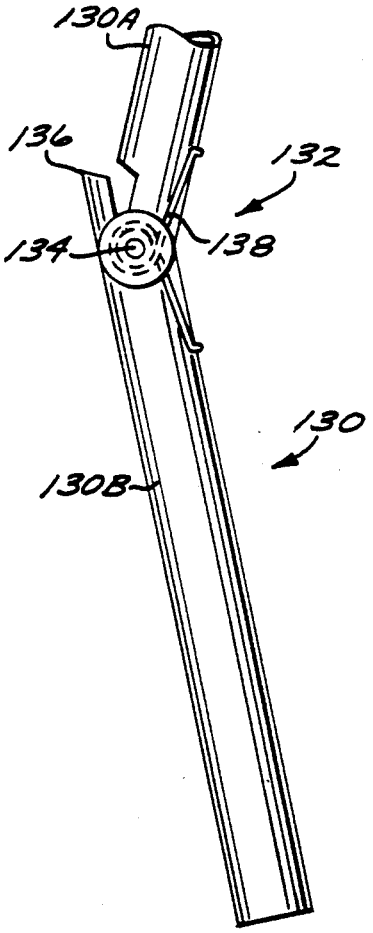

FIGS. 9–11 illustrate yet another form of the rod 62. This rod 130 employs a knee joint 132 that is configured to bend in one direction only, i.e., toward the interior of the bag. This direction of bend predictably forces the legs 70 and 72 to open. The knee joint 132 is shown in enlarged view in FIG. 10, and in a bent configuration in FIG. 11. In essence the knee joint 132 is formed at a pivot pin 134, which joins the upper rod member 130A to the lower rod member 130B at the knee pivot point. The stop surface 136 comprising rod 130B prevents the knee joint from bending in the direction opposite to that shown in FIG. 11. A spring 138 biases the knee joint to the straightened position shown in FIG. 10.

Other forms of the rod 62 could also be employed, to provide the function of allowing shortening the distance between the top an bottom members under a force applied by the bag holder, while resisting such distance shortening and providing a force tending to restore the distance to its nominal distance with the legs in the upright position against the bag body. For example, a telescoping rod incorporating a coil spring could be employed, wherein the rod length is compressible, and tends to be restored to an uncompressed position when the compression force is removed.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A golf bag with integrated support legs, comprising:

a golf bag body fabricated from a flexible lightweight material;

a top support member fabricated of a rigid material defining a top opening of said golf bag, said bag body being secured at the top thereof to said top support member;

a bottom support member fabricated of a rigid material, said bag body being secured at the bottom thereof to said bottom support member;

a rod member extending upright along one side of said bag body, the top rod end being secured at said top support member, the bottom rod end being secured at said bottom support member, said rod member being characterized in that the distance between its top end and bottom end is compressible in response to a compression force, and in that said rod resists said compression force and resiliently returns to its non-compressed condition upon release of said compression force;

first and second leg members, each leg member having a top end and a bottom end, said top end pivotally connected at said top support, member; and a substantially rigid spring member connected between said bottom member and each leg in a position between said top and bottom ends of said leg, wherein exerting a downwardly extending compression force on said rod as the bag is in an upright position with said bottom member resting on the ground causes said distance between the rod ends to compress and said legs to be pivoted outwardly away from said bag body into a stand position, said legs being automatically retracted to an upright position against said bag body upon lifting said bag off the ground.

2. The golf bag of claim 1 wherein said spring member is characterized by a general U-shape, with a relatively short horizontal member connecting two elongated spring upright members, said horizontal member being secured adjacent to said bottom member between said two leg members, each spring upright member having an end which is pivotally connected to a corresponding one of said leg members at said respective position intermediate said top and bottom ends of said legs.

3. The golf bag of claim 2 wherein said two upright spring members are further characterized by a dogleg portion adjacent said respective ends which are pivotally connected to said leg member, said dogleg portions tending to bias the position of said leg members away from the golf bag body and assist the movement of said legs from an upright position to said stand position.

4. The golf bag of claim 3 wherein said two upright spring members are further characterized by a further angled portion at the ends thereof which are received into a hole formed in said respective leg members.

5. The golf bag of claim 1 wherein said rod is characterized by a first and second relatively rigid rod sections joined by a coil spring, permitting said first and second rod sections to flex so that they are offset relative to each other, wherein the distance between said top and bottom rod ends is compressed, the coil spring biasing the two rod sections to an aligned position.

6. The golf bag of claim 1 further comprising a sleeve in which said rod extends along the length of said bag body.

7. The golf bag of claim 1 wherein said rod member comprises a knee joint permitting said rod member to bend unidirectionally at a knee joint toward the interior of said bag in response to said compression force, and a spring member for biasing said knee joint to a straightened position.

8. A golf bag with integrated support legs, comprising:

a golf bag body fabricated from a flexible lightweight material;

a top support member fabricated of a rigid material defining a top opening of said golf bag, said bag body being secured at the top thereof to said top support member;

a bottom support member fabricated of a rigid material, said bag body being secured at the bottom thereof to said bottom support member;

a flexible rod member extending upright along one side of said bag body, the top rod end being secured at said top support member, the bottom rod end being secured at said bottom support member;

first and second leg members, each leg member having a top end and a bottom end, said top end pivotally connected at said top support member; and a substantially rigid member connected between said bottom member and each leg in a position between said top and bottom ends of said leg, wherein exerting a downwardly extending force on said rod as the bag is in an upright position with said bottom member resting on the ground causes said rod to flex and said legs to be pivoted outwardly away from said bag body into a stand position, said legs being automatically retracted to an upright position against said bag body upon lifting said bag off the ground.

9. The golf bag of claim 8 wherein said rigid member is characterized by a general U-shape, with a relatively short horizontal member connecting two elongated spring upright members, said horizontal member being secured adjacent to said bottom member between said two leg members, each spring upright member having an end which is pivotally connected to a corresponding one of said leg members at said respective position intermediate said top and bottom ends of said legs.

10. The golf bag of claim 9 wherein said two upright spring members are further characterized by a dogleg portion adjacent said respective ends which are pivotally connected to said leg member, said dogleg portions tending to bias the position of said leg members away from the golf bag body and assist the movement of said legs from an upright position to said stand position.

11. The golf bag of claim 10 wherein said two upright spring members are further characterized by a further angled portion at the ends thereof which are received into a hole formed in said respective leg members.

12. The golf bag of claim 8 wherein said flexible rod is characterized by a first and second relatively rigid rod sections joined by a coil spring, permitting said first and second rod sections to flex so that they are offset relative to each other, the coil spring biasing the two rod sections to an aligned position.

13. The golf bag of claim 8 further comprising a sleeve in which said rod extends along the length of said bag body.

14. The golf bag of claim 8 further comprising a section of rigid material along the outside of said bag body to restrain the movement of said rod as the rod flexes so that the rod flexes inwardly toward the inside of said bag body.

15. The golf bag of claim 8 wherein said rod member comprises an elongated section of coil spring extending substantially between said top support member and said bottom support member.

16. A golf bag with integrated support legs, comprising:

a golf bag body fabricated from a flexible lightweight material;

a top support member fabricated of a rigid material defining a top opening of said golf bag, said bag body being secured at the top thereof to said top support member;

a bottom support member fabricated of a rigid material, said bag body being secured at the bottom thereof to said bottom support member;

a rod member extending upright along one side of said bag body, the top rod end being secured at said top support member, the bottom rod end being secured at said bottom support member, said rod member being characterized in that the distance between its top end and bottom end is compressible in response to a compression force, and in that said rod resists said compression force and resiliently returns to its non-compressed condition upon release of said compression force, said rod member comprising a knee joint permitting said rod to bend unidirectionally at a knee joint toward the interior of said bag in response to said compression force, and a spring member for biasing said knee joint to a straightened position;

first and second leg members, each leg member having a top end and a bottom end, said top end pivotally connected at said top support member; and a substantially rigid spring member connected between said bottom member and each leg in a position between said top and bottom ends of said leg, wherein exerting a downwardly extending compression force on said rod as the bag is in an upright position with said bottom member resting on the ground causes said distance between the rod ends to compress and said legs to be pivoted outwardly away from said bag body into a stand position, said legs being automatically retracted to an upright position against said bag body upon lifting said bag off the ground.

17. The golf bag of claim 16 wherein said spring member is characterized by a general U-shape, with a relatively short horizontal member connecting two elongated spring upright members, said horizontal member being secured adjacent to said bottom member between said two leg members, each spring upright member having an end which is pivotally connected to a corresponding one of said leg members at said respective position intermediate said top and bottom ends of said legs.

18. The golf bag of claim 17 wherein said two upright spring members are further characterized by a dogleg portion adjacent said respective ends which are pivotally connected to said leg member, said dogleg portions tending to bias the position of said leg members away from the golf bag body and assist the movement of said legs from an upright position to said stand position.

19. The golf bag of claim 18 wherein said two upright spring members are further characterized by a further angled portion at the ends thereof which are received into a hole formed in said respective leg members.

* * * * *